US007089598B2

(12) United States Patent
Sallas et al.

(10) Patent No.: US 7,089,598 B2
(45) Date of Patent: Aug. 15, 2006

(54) INFANT PANTS HAVING KNEE POCKETS AND REPLACEABLE KNEE PADS

(75) Inventors: Margueritte Sallas, Montgomery, TX (US); Alicia McCarrell, Montgomery, TX (US)

(73) Assignee: Kneekerbonkers LLC, Montgomery, TX (US)

( * ) Notice: Subject to any disclaimer, the term of this patent is extended or adjusted under 35 U.S.C. 154(b) by 0 days.

(21) Appl. No.: 10/812,365

(22) Filed: Mar. 22, 2004

(65) Prior Publication Data

US 2005/0060782 A1 Mar. 24, 2005

Related U.S. Application Data

(60) Provisional application No. 60/503,957, filed on Sep. 18, 2003.

(51) Int. Cl.
*A41D 1/06* (2006.01)

(52) U.S. Cl. ..... 2/79

(58) Field of Classification Search ..... 2/22–24, 2/62, 79, 227, 242, 69, 267, 268, 247–253, 2/256, 257, 455, 404, 407, 911; 128/881, 128/882; 602/23, 26, 61–63
See application file for complete search history.

(56) References Cited

U.S. PATENT DOCUMENTS

| | | | | |
|---|---|---|---|---|
| 4,561,124 | A * | 12/1985 | Thompson | 2/23 |
| 6,049,906 | A | 4/2000 | Aldridge | |
| 6,289,524 | B1 * | 9/2001 | Wright et al. | 2/455 |
| 6,317,893 | B1 * | 11/2001 | Walton | 2/227 |
| 6,327,713 | B1 | 12/2001 | Gomez | |
| 6,332,224 | B1 | 12/2001 | Walker et al. | |
| 6,338,164 | B1 | 1/2002 | Howard | |
| 6,421,839 | B1 | 7/2002 | Vo et al. | |
| 6,751,804 | B1 * | 6/2004 | Warner et al. | 2/23 |
| 2003/0005505 | A1 | 1/2003 | DeMott | |

* cited by examiner

*Primary Examiner*—Tejash Patel
(74) *Attorney, Agent, or Firm*—Gary L. Bush, Esq.; Andrews Kurth LLP

(57) ABSTRACT

An apparatus for infant pants having knee pads permanently or removably mounted to an inner surface of the pants or to an infant pants inner liner. The infant pants or pants liner have internal pocket panels that extend substantially horizontally from seam to seam and are sewn by vertical, substantially parallel stitching to define generally rectangular pad pockets of desired dimensions with upwardly facing pocket openings. The pockets have retainer panels to secure a replaceable protective pad within the pad pocket. The pants have replaceable protective knee pads that are removably contained within the internal knee pockets to provide protection for crawling infants against bruises and abrasion of the knees during crawling activity.

10 Claims, 2 Drawing Sheets

INFANT PANTS HAVING KNEE POCKETS AND REPLACEABLE KNEE PADS

CROSS REFERENCE TO RELATED APPLICATION

This application is based upon provisional application 60/503,957 filed on Sep. 18, 2003, the priority of which is claimed.

BACKGROUND OF THE INVENTION

1. Field of the Invention

The present invention relates generally to clothing and particularly to pants for infants having replaceable knee pads disposed in knee pockets and secured therein with retainer panels, the knee pads designed and arranged to protect the knees of infants when crawling.

2. Description of the Prior Art

During the pre-walking stage of human development, toddlers move about by crawling on their hands and knees. It is desirable to protect the knees and shins of the toddlers, who are on their knees for extended periods of time. It is important to pad the toddlers' knees not only to increase their comfort but also to avoid damage, such as bruises and abrasions to the knees and shins.

Knee pads which are secured to pants are known in the art. For example, U.S. Pat. No. 6,049,906 issued to Aldridge shows a hazardous duty garment with knee pads that are stitched to the outer surface of the shell material from which the garment is made, and U.S. Pat. No. 6,421,839 issued to Vo et al. shows work pants with pockets containing cushioning pads. The positions of the cushions are adjustable relative to the pockets. However, having knee pads or pockets visible on the other surface of the garment is considered by some consumers to be unsightly.

U.S. Pat. No. 6,289,524 issued to Wright et al. shows a disposable protective garment having internal pockets within which pads are located. However, this garment is limited to a coverall designed to cover a majority of a wearer's skin. Alternatively, U.S. Pat. No. 6,332,224 issued to Walker et al. shows knee pads for infants which are incorporated in long socks or knee covers, and U.S. Pat. No. 6,338,164 issued to Howard shows protective chaps having pockets at the shin and knee areas to receive shin and knee pads.

It would be advantageous to have knee pads contained in the interior portions of infant pants for protection of the infants' knees.

3. Identification of Objects of the Invention

A primary object of the invention is to provide novel infant pants having knee pockets and replaceable knee pads with a thickness that can be varied according to the weight and other physical characteristics of a particular infant, to thus provide knee protection as the infant crawls about on a floor surface.

Another object of the invention is to provide novel infant pants or overalls having internal, washable knee pads that are permanently sewn to the interior surface of infant pants or pants liners to comfort and protect an infant's or toddler's knee area during crawling activity.

Another object of the invention is to provide novel infant pants having knee pockets that are affixed to the inner surface of the infant pants or pants liner and have replaceable knee pads composed of material having desired cushioning capability and being sufficiently flexible to readily bend as the knees of a wearing infant or toddler bend.

SUMMARY OF THE INVENTION

The objects identified above, as well as other features and advantages of the invention are incorporated in an apparatus for novel infant pants, toddler pants or overalls that may be unlined or may have inner liners for all or part thereof. To the inner surface of the pants material, or the pants liner material as the case may be, a panel of pocket material, which may be made of the same material as a pants liner, is sewn from leg seam to leg seam and is oriented substantially horizontally. Stitching along the bottom of the panel of pocket material secures the bottom of the pocket panel to the pants or pants liner material and also forms a closure for the bottom of a pad pocket.

A top portion of the pocket panel material is folded over and is oriented so as to be located interiorly of the pad pocket and extends downwardly a substantial depth of the pad pocket. This fold of the pocket panel defines a pad retaining panel within the pad pocket. Generally vertically oriented parallel stitching is made to establish a knee pocket of a desired width.

A knee pad having a thickness of about ¼ inch and composed of a material or combination of materials to provide efficient cushioning with good wear resistance and protection against abrasion for an infant's knees is inserted into a pad pocket to the full extent possible, and the pad retaining panel is then located over the top of the knee pad to thus secure the knee pad within the pad pocket. For example, the knee pad may be composed of a material having, about 87 percent Tactel Nylon and about 13 percent Lycra Spandex. The knee pads are thus replaceable and are readily washed and dried without any loss of the cushioning and protective characteristics thereof.

BRIEF DESCRIPTION OF THE DRAWINGS

The invention is described in detail hereinafter on the basis of the embodiments represented in the accompanying figures, in which.

DETAILED DESCRIPTION OF THE PREFERRED EMBODIMENT

The term infant pants as used herein is intended to encompass any garment for infants and toddlers that cover the legs and knees of infants or toddlers, such as pants garments, bibbed overall garments and the like.

Figure 1:
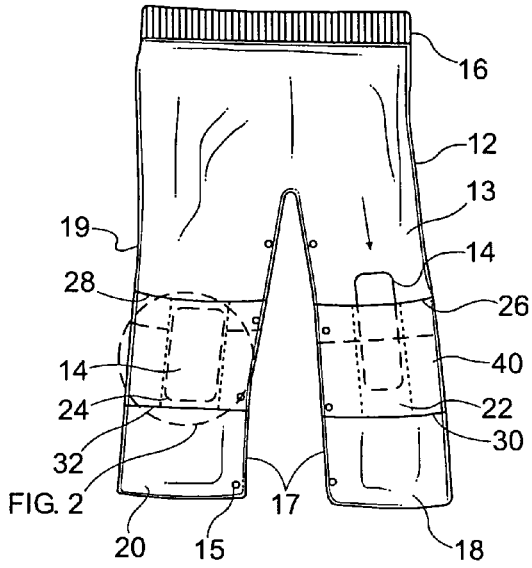
FIG. 1 is a plan view of the infant pants according to the invention, the pants being shown inside out and illustrating the location of knee pockets that are designed for receiving knee pads.

FIG. 1 illustrates infant pants 12 according to the invention, turned inside-out to expose the fabric inner surface 13. The pants garment 12 is provided with leg members 18 and 20 which, in the case of many infant pants garments, may be open seamed, closed by snap retainers, buttons, zippers or the like 15 and thus capable of being easily and quickly opened, such as for the purpose of periodically changing diapers. Typically the inner leg seams 17 of infant pants are closed in this manner, while the outer leg seams 19 are closed by stitching from the region of the waist band to the bottom of the legs. The infant pants garment 12 is provided with the usual elastic waist-band 16 enabling the pants to fit a rapidly growing infant for a longer period of time and to accommodate the physical differences of infants.

The infant pants 12 are designed with knee pockets 22, 24 which receive knee pads 14 to provide the infant pants with padding to protect an infant's knees from becoming bruised, sore or having damaged skin due to contact with hard or rough surfaces such as floors, concrete surfaces or the like. Inner knee pockets 22 and 24 are attached, such as by stitching, to the inner surface 13 of the infant pants. The top ends of the knee pockets 22 and 24 are indicated by lines at 26 and 28 and the bottom ends of the knee pockets are indicated by lines at 30 and 32. The knee pockets 24, 26 and the knee pads 14 extend generally from mid thigh to mid calf so that not only the knees but also the thighs and calf regions of an infant's leg anatomy are efficiently protected from damage.

Figure 2:
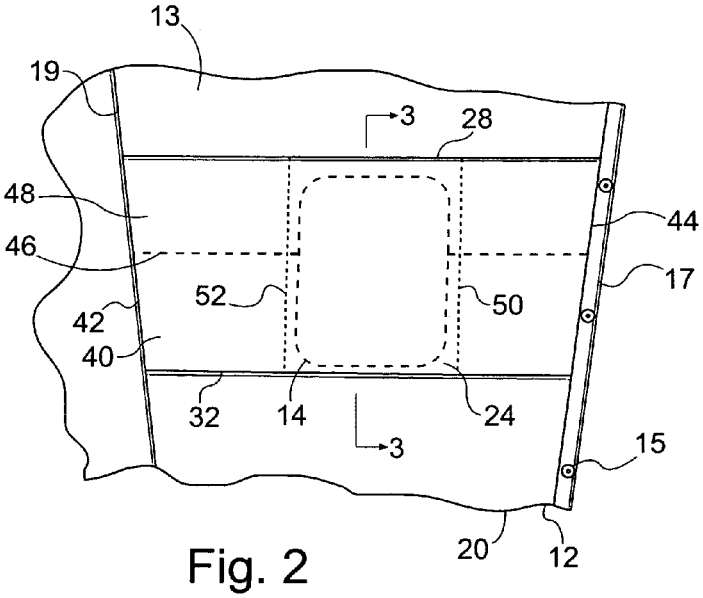
FIG. 2 is an enlarged view of a portion of FIG. 1 showing the inside of an infant pants garment with a generally horizontally oriented pad pocket panel and the stitching that defines a pad pocket having an upwardly facing pad insertion opening.

FIG. 2 is an illustration showing the pocket 24 detail of FIG. 1, including part of the inner surface of pants leg 20 having an outer leg seam 19 and an inner leg seam 17. The inner leg seam is generally hemmed for finishing and reinforcement and is typically provided with snap fasteners or other suitable fasteners 15. A pocket panel 40 having hemmed edges 32, 42, 44 and 46 is oriented generally horizontally as shown to form pocket 24. A retaining panel 48 is formed from the upper portion of the pocket panel 40 by folding the pocket panel towards the inner surface 13 of the pants 12 along line 28. The fold 28, which remains free from the inner surface 13, forms the top edge of pocket 24. The bottom edge 46 of the retaining panel 48 is located between the fold 28 and the bottom edge 32 of the pocket panel 40 and extends well into the pocket 24. The side edges 42 and 44 of pocket panel 40 are stitched in place by the outer leg seam 19 and the inner leg seam 17, respectively. The bottom of the pocket 24 is closed by horizontal stitching that secures the lower edge 32 of pocket panel 40 to the inner surface of the pants 13. A pair of spaced, substantially parallel stitch lines 50, 52 establish the sides of pad pocket 24. The top 28 of the pad pocket 24 is open to receive a knee pad 14, with the retainer panel 48 being located within the pad pocket 24. Although not illustrated, stitching along the top edge 28 of pocket 24 can be used to give the pocket a finished appearance.

Figure 3:
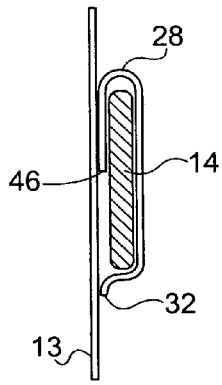
FIG. 3 is a sectional view taken along line 3—3 of FIG. 2 and showing a lined knee pad within a pad pocket and further showing retention of the knee pad within the pad pocket by an internal retainer panel.

As shown in FIGS. 1–3, a knee pad 14 is inserted through the open top 28 of the pad pocket 24 and is moved downwardly until its lower edge is substantially supported by the bottom 32 of the pad pocket. The lower edge 46 of the retainer panel 48 is then manipulated over the top edge of the knee pad 14, and the retainer panel 48 is arranged smoothly over the knee pad 14 to secure the knee pad 14 within the pad pocket 24. The knee pad 14 may be inserted into or removed from the pad pocket 24 as desired for cleaning or for replacement. In the event a particular knee pad is deemed to be too thin for a particular infant or toddler, the pad may be replaced with a different knee pad having a slightly greater thickness.

FIG. 3 is a cross section taken along lines 3—3 of FIG. 2. The illustration clearly shows retainer panel 48 capturing knee pad 14 to prevent inadvertent loss of the pad.

Figure 4:
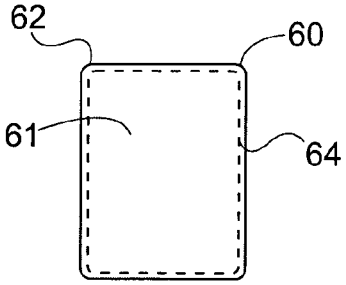
FIG. 4 is a front plan view showing a lined knee pad that is constructed according to the invention for use in a knee pocket of the infant pants of FIG. 1.

A knee pad for insertion into a knee pocket of the infant pants is shown generally at 60 in FIG. 4. Knee pads 60 have a generally rectangular pad panel 61 which is formed from a piece of pad material such as a foam-sealant material which is very light weight and has a thickness of about ¼ inch. A pad 60 assembled from Nylon and Spandex panels 61 that may be sandwiched to a thickness of about ¼ inch is preferred. The individual knee pad panels 61 are then further formed if desired, such as by rounding the corners 62 and by covering the pads with a suitable lining material 64, for example the pocket panel fabric. The knee pad lining 64 makes the knee pads 60 more durable, such as for washing and drying and renders the finished knee pad to a condition that enables the knee pads to be easily inserted into and removed from the knee pockets. The knee pad lining material is typically sewn along the edges.

Figure 5:
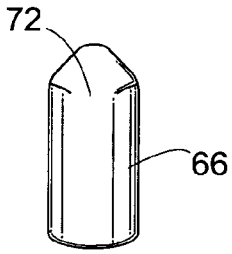
FIG. 5 is a front plan view of a contoured knee pad according to the invention.
Figure 6:
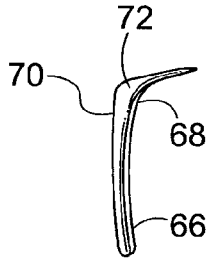
FIG. 6 is a side profile view of FIG. 5.

An alternative knee pad 66, as shown in FIGS. 5 and 6, may have a slightly curved configuration with a concave pad surface 68 to substantially conform to the curvature of the infant's thighs, knees and calves and a convex pad surface 70 to face away from the legs of the infant. The knee pads 66 may also be provided with flexible or angulated sections as shown at 72, thus providing for efficient bending of the pads at the knees of the infant. The knee pads 66 are preferably composed of material having desired cushioning capability and being sufficiently flexible to readily bend as the knees of a wearing infant or toddler bend.

According to another embodiment of the invention, knee pads of the nature set forth above may be permanently affixed to the inner surfaces of the leg material of the pants. In this case, the knee pads are not removable for cleaning, but are cleaned simply by washing and drying the infant pants garment.

Figure 7:
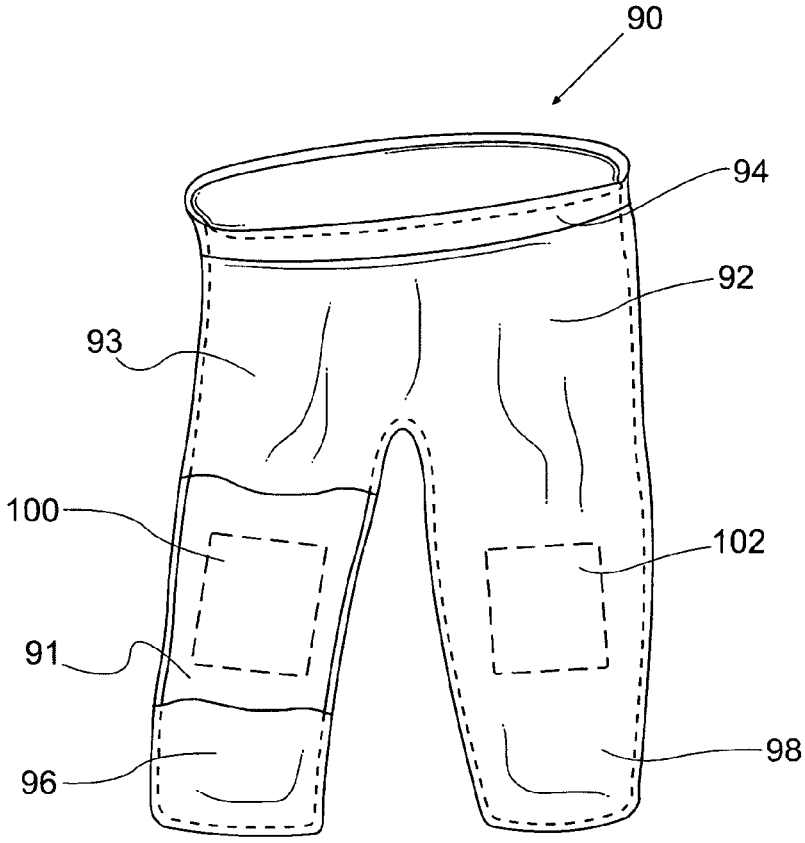
FIG. 7 is a perspective view showing lined infant pants according to the invention and showing the location of a knee pad at the knee region of the pant lining.

Referring now to FIG. 7, an alternate embodiment of the invention is shown, which is in the form of infant pants shown generally at 90 and having a body section 92 that is typically provided with a gathered elastic waist band 94. The pants garment 90 is also provided with leg sections 96 and 98 that cover the legs of an infant or toddler. The pants garment 90 is shown with a section of outer fabric 93 cut away to expose a pants lining 91 that typically lines the entire garment. The lining may be removable or permanently attached to the outer garment. The leg sections 96 and 98 are each provided with knee pads 100 and 102 that typically extend from about mid-thigh to about mid-calf of an infant or toddler. The knee pads 100 and 102 may be replaceable knee pads contained in pockets or may be permanently attached to the inner lining 91. Further, the knee pads 100, 102 may be located on the surface of the inner lining 91 facing the outer fabric 93 (for removable linings) or on the surface of the inner lining 91 which faces a wearer. Although many pocket constructions may be used to contain the knee pads 100, 102, the pocket design described above and illustrated in FIGS. 1–3 is preferably used.

While the preferred embodiments of the invention have been illustrated in detail, it is apparent that modifications and adaptations of the preferred embodiments will occur to those skilled in the art. Such modifications and adaptations are in the spirit and scope of the invention as set forth in the following claims:

What is claimed is:

1. An infant pants garment comprising, an inner lining designed and arranged to cover substantially the entire legs of an infant, an outer fabric designed and arranged to cover substantially the entire legs of an infant coupled to and completely covering said inner lining, a pocket panel coupled to said inner lining, and a pad disposed between said pocket panel and said inner lining.

2. The garment of claim 1 wherein, said pocket panel is disposed on an inner surface of said inner lining.

3. The garment of claim 1 wherein, said pocket panel is disposed on an outer surface of said inner lining.

4. The garment of claim 1 wherein, said pad is removably coupled between said pocket panel and said inner lining.

5. The garment of claim 1 wherein, said pad is permanently disposed between said pocket panel and said inner lining.

6. The garment of claim 1 wherein said pocket further comprises, a retaining panel disposed between said pocket panel and said inner lining, said pad partially disposed between said retaining panel and said pocket panel.

7. The garment of claim 1 wherein, said inner lining is removably disposed inside said outer covering.

8. The garment of claim 1 wherein, said inner lining is permanently disposed inside said outer covering.

9. The garment of claim 1 wherein, said pocket panel is disposed in said inner lining at a location corresponding generally to a knee of said wearer.

10. An infant pants garment comprising, an outer fabric covering defining first and second leg sections and a torso section designed and arranged to cover the legs of an infant, an inner lining disposed inside said outer fabric covering and coupled thereto such that substantially the entire outer fabric covering is lined, a first pocket characterized by four edges, said first edge of said first pocket folded over against said inner lining and unfastened thereto, said second, third and fourth edges of said first pocket secured to said inner lining in a knee region of said first leg section, a first pad characterized by a shape and size to fit in said first pocket, said first pad removably disposed between said first pocket and said inner lining with a portion of said first pad disposed between said first pocket and said first folded edge of said first pocket, a second pocket characterized by four edges, said first edge of said second pocket folded over against said inner lining and unfastened thereto, said second, third and fourth edges of said second pocket secured to said inner lining in a knee region of said second leg section, a second pad characterized by a shape and size to fit in said second pocket, said second pad removably disposed between said second pocket and said inner lining with a portion of said second pad disposed between said second pocket and said first folded edge of said second pocket, an openable seam disposed longitudinally along said first leg section, and a fastener disposed at said openable seam designed and arranged to close said openable seam.

* * * * *